US005400870A

United States Patent [19]

Inoue

[11] Patent Number: 5,400,870

[45] Date of Patent: Mar. 28, 1995

[54] SCAFFOLDING FRAME SYSTEM

[75] Inventor: Syunsaku Inoue, Ikeda, Japan

[73] Assignee: Alinco, Inc., Osaka, Japan

[21] Appl. No.: 200,936

[22] Filed: Feb. 22, 1994

Related U.S. Application Data

[63] Continuation of Ser. No. 830,352, Jan. 31, 1992, abandoned.

[30] Foreign Application Priority Data

Jun. 24, 1991 [JP] Japan ..... 3-180153
Jun. 24, 1991 [JP] Japan ..... 3-180154

[51] Int. Cl.[6] ..... E04G 1/14
[52] U.S. Cl. ..... 182/178; 52/637
[58] Field of Search ..... 182/178, 179; 248/158.5; 52/638, 637

[56] References Cited

U.S. PATENT DOCUMENTS

| | | | |
|---|---|---|---|
| 793,576 | 6/1905 | Follmer | 248/188.5 X |
| 1,042,417 | 10/1912 | Erickson | 248/188.5 X |
| 2,473,388 | 6/1949 | Rambo | 182/178 X |
| 4,891,926 | 1/1990 | Allenbaugh | 182/178 X |

FOREIGN PATENT DOCUMENTS

| | | | |
|---|---|---|---|
| 1-131753 | 9/1989 | Japan . | |
| 510938 | 8/1939 | United Kingdom | 182/178 |

*Primary Examiner*—Alvin C. Chin-Shue
*Attorney, Agent, or Firm*—Schweitzer Cornman & Gross

[57] ABSTRACT

A scaffolding frame system comprising a pair of lower elongated vertical members each having an elongated linking member at the upper end of a vertical member for releasingly attaching the linking member to the upper end, a pair of upper elongated vertical members for releasingly attaching a respective lower end thereof to a linking member in a respective lower elongated vertical member.

3 Claims, 4 Drawing Sheets

SCAFFOLDING FRAME SYSTEM

This is a continuing application of U.S. Ser. No. 830,352, filed on Jan. 31, 1992, now abandoned.

FIELD OF THE INVENTION

The present invention relates to a provisional scaffolding to be assembled upwardly from below.

BACKGROUND OF THE INVENTION

In setting up a scaffold frame upwardly from below at construction sites, the scaffold frame members have to be linked to each other, one above the other. Linking members are conventionally employed for this purpose, including a linkage pin projected through each of the right and left upper ends of the lower scaffold frame member, and each of the right and left lower ends of the upper scaffold frame member. An arcuate locking arm is applied on each side to join the upper and lower members. Or, as disclosed in Japanese published utility model No. Hei. 1-131753, a linkage pin is inserted between upper and lower scaffold frame members, and by rotating the linkage pins by a specified angle, the concave and convex parts of the scaffold frame and linkage pin are mutually engaged with each other, thereby linking the upper and lower scaffold frame members.

In such prior art structures, apart from the procedure of inserting the upper scaffold frame member into the lower scaffold frame member the locking arms at the right and left sides have to be locked in place while keeping together the upper and lower scaffold frame members, or the right and left linkage pins, have to be rotated between the two frame members, and at least two workers are required to create the linkage, and the linking procedure is complicated and inefficient.

DESCRIPTION OF THE INVENTION

The above and other problems of the prior art structures are improved upon by automatically linking the upper and lower scaffold frame members by inserting the lower end of the upper scaffold frame member into a linkage pin of the lower scaffold frame members, so that the linking procedure can be carried out in an extremely simple manner, and thus the scaffolding frame can be efficiently assembled by a minimum number of workers.

The present invention also enables linking and disassembly of both scaffold frame members only by pressing a lever lightly by the tip of the foot of the worker, when inserting the lower end of the upper scaffolding frame member into a linkage pin of the lower scaffolding frame member, so that the linking and disassembly procedures can be carried out in an extremely simple manner, and the scaffold frame can be assembled and disassembled efficiently by a minimum number of workers.

DESCRIPTION OF THE DRAWING

The invention is described in greater detail with reference being had to the drawing, wherein.

DETAILED DESCRIPTION OF THE INVENTION

Figure 1:
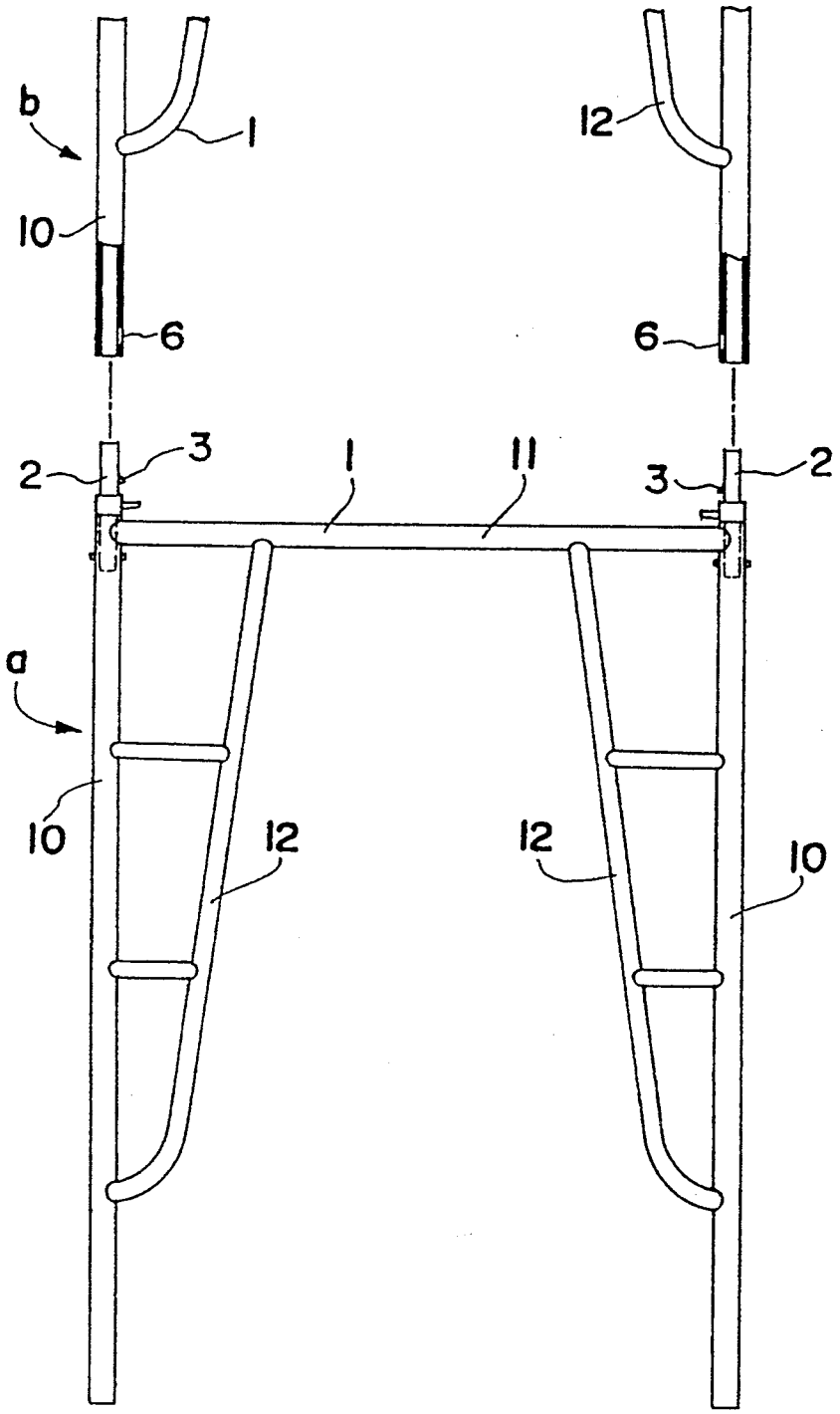
FIG. 1 is a front elevational view of an embodiment of the invention.

FIG. 1 shows the state before linkage of a lower scaffolding frame member "a" and an upper scaffolding frame member "b" prior to their being linked to each other. Each scaffolding frame member has vertical linkage pins 2 located in attaching openings at its top on each side. Each scaffolding frame member 1 comprises right and left vertical side members, such as pipes 10, a cross piece 11 for connecting the vertical side members 10, and reinforcing braces 12, attached between each of the vertical side members 10 and the cross piece 11. Lower engaging holes 6 are provided at the side of the lower end of each vertical side member 10 and upper engaging projections 3 are provided on the linkage pins 2 for the lower engaging holes 6 in an upper scaffolding frame member "b".

Figure 2:
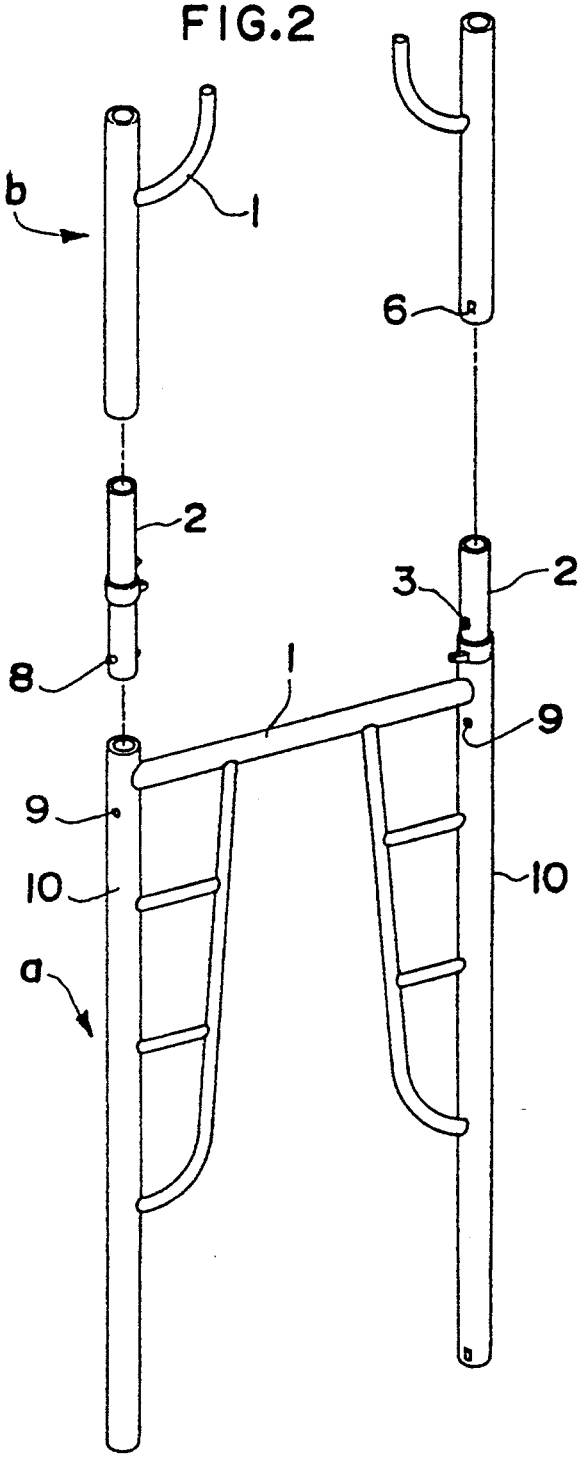
FIG. 2 is a perspective view thereof.

As shown in FIG. 2, the vertical linkage pins 2 are part of a linking member 8, having a locking projection 8*a* protruding from its lower side. An upper engaging hole 9 is to be engaged with the locking projection 8*a*, is provided near the upper ends of each of the vertical side members 10.

Figure 3:
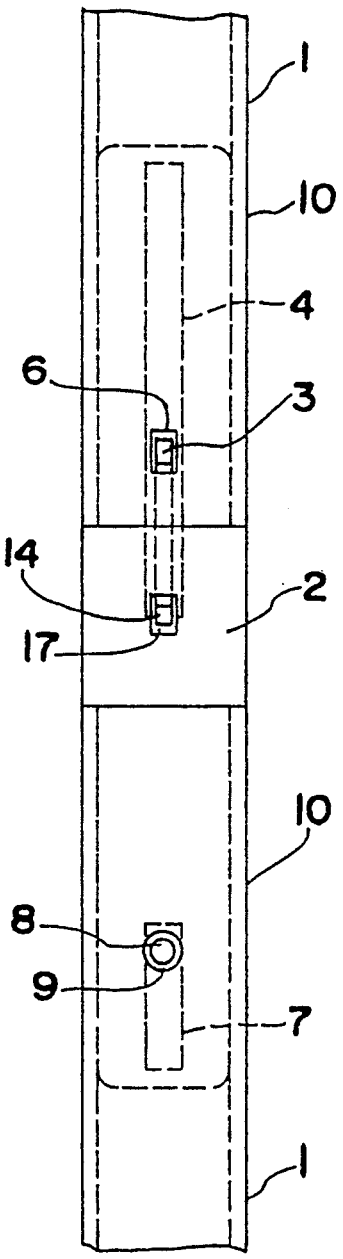
FIG. 3 is a side elevational view thereof.
Figure 4:
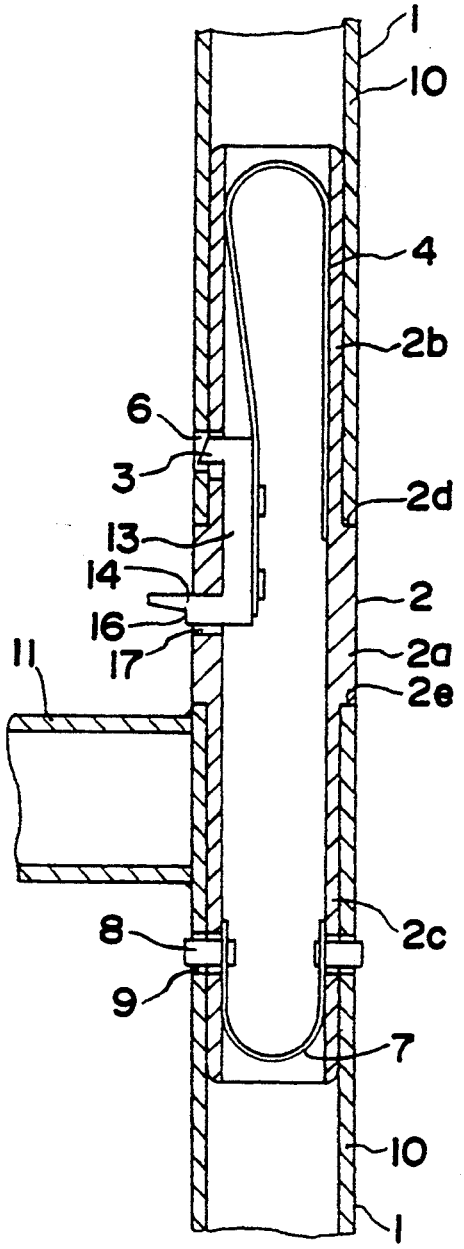
FIG. 4 is a partial cross-sectional front view thereof.

Linked parts of the assembled lower scaffolding frame member "a" and the upper scaffolding fame member "b" are shown in FIG. 3. FIG. 4 shows the internal structure of the linking member 8. The vertical linkage pin portion 2 of the linking member, has a tubular shape which penetrates at 2*b* vertically into the lower interior portion of an upper scaffolding frame member "b". The middle part 2*a* of the vertical linkage pin 2 is formed with a greater wall thickness, and outer upper and lower stepped parts 2*d*, 2*e* are formed between the upper part 2*b* and the lower part 2*c* of the vertical linking pin 2. The lower end of the vertical side member 10 of the upper scaffolding frame member "b" is inserted into the upper part 2*b* of the vertical linkage pin 2 and the upper end of the vertical side member 10 of the lower scaffolding frame member "a" is inserted into the lower part 2*c* of the vertical linkage pin 2. The respective upper and lower ends of the vertical side members 10 are abutted and positioned against the respective upper and lower outer stepped parts 2*d*, 2*e*. At that position the upper locking projection 3 of the vertical linkage pin 2 is engaged with the lower engaging hole 6 at the lower end of the vertical side member 10 of the upper scaffolding frame member "b", and the linking member 8 is engaged with the upper engaging hole 9 at the upper end of the vertical side member 10 of the lower scaffolding frame member "a".

As shown in FIGS. 4–8, the upper locking projection 3 has a sloping sliding surface 5 with a flat or a slightly curved slope formed at the front. The engaging projection 3 is formed into an approximately U-shaped engaging member 15, wherein the upper locking projection 3 terminates at the upper end of a connecting portion 13 extending downward from the projection 3 to an actuating lever 14 extending further outwardly than projection 3 in the same outward direction as the locking projection 3. As shown in FIG. 4 one end of an approximately U-shaped leaf spring 4 is attached to the back side of the engaging member 15 by crimping or spot welding, or the projection on its back side is engaged with a tiny hole provided in the leaf spring 4, thereby joining the two. The other end of the leaf spring 4 is laid without attachment against the inner surface of the upper part 2*b* of the vertical linkage pin 2, so that the upper locking projection 3 of the engaging member 15 and its actuating lever 14 are thrust by the leaf spring 4 to project outwardly from the side of the upper part 2*b* of the linkage pin 2, and its thicker wall part 2*a*. An engaging step 16 is provided at the lower side of the actuating lever 14.

As shown in FIG. 4, the locking projection 8*a* in the side of the lower part 2*c* of the linking member 8 is configured as a pair of right and left pieces are connected to each other by a U-shaped leaf spring 7 and both locking projections 8*a* project from the side of the lower part 2*c* of the linkage pin 2, under the action of the leaf spring 7.

As shown in FIG. 4, in use the lower part 2*c* of the linking member 8 is inserted into the upper end of the vertical side member 10 of the lower scaffolding frame member "a", with the locking projection 8*a* projecting from the side of the linking member 8 against the bias of the leaf spring 7, and the locking projection 8*a* is pushed through the upper engaging hole 9 of the vertical side member 10. As a result, the linkage pin 2 becomes attached to the upper end of the vertical side member 10, so that it is no longer necessary thereafter to remove it therefrom.

Figure 6:
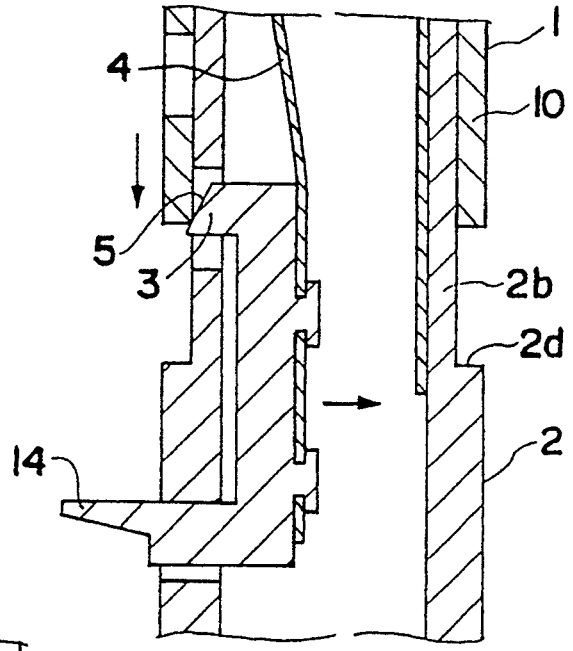
FIGS. 6–8 are partial cross-sectional front views showing the engaging member in its various operational settings.
Figure 7:
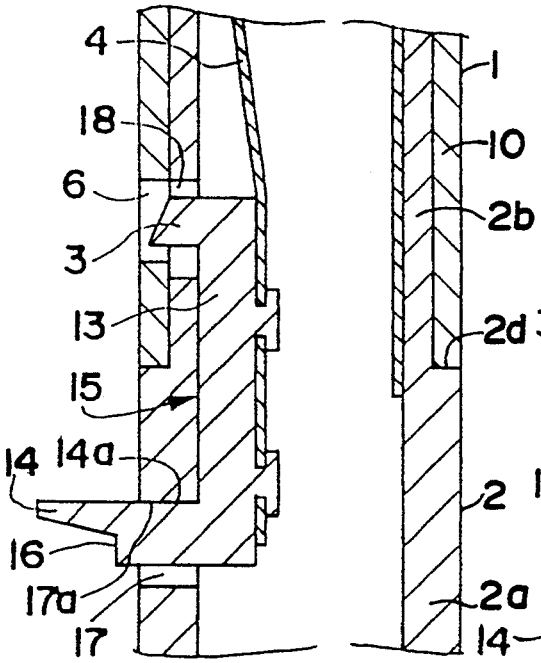

Next, as shown in FIG. 6, by inserting the vertical side member 10 of the upper scaffolding frame member "a" into the upper part 2*b* of the linkage pin 2, the lower end of the vertical side member 10 abuts against the sloping sliding surface 5 which is the front of the upper locking projection 3. The upper locking projection 3 is pushed back into the interior of the vertical linking pin 2 against the bias of the leaf spring 4. The lower end of the vertical side member 10 of the upper scaffolding frame member "b" is inserted over the vertical linkage pin 2 until it abuts against the step part 2*d* of the upper part 2*b* of the linkage pin 2. As shown in FIG. 7, when the lower end of the vertical side member 10 abuts against the step part 2*d*, and the upper locking projection 3 becomes aligned with and projects into the lower engaging hole 6 in the side of the vertical side member 10, and the upper locking projection 3 thus becomes released from the inward pushing effect of the vertical side member 10. The projection of the upper locking projection through the lower engaging hole 6 thus links the upper and lower scaffolding frames "a" and "b" together.

Since the upper locking projection 3 is formed from a thick, rectangular one-piece metal engaging member 15 the lower engaging hole 6 in the vertical side member 10 to be engaged therewith is suitable similarly of a rectangular shape that is somewhat larger than the size of the locking projection 3 as shown in FIG. 3, from the view of preventing a loose fit.

Thus, the lower and upper scaffolding frame members "a" and "b" connected to each other through engagement with the upper locking projections 3 not to slip out of each other, and it is a feature of the present invention that the locking force is not provided by the upper locking projection 3 at the side of the vertical linkage pin 2, but by the actuating lever 14 which is integral therewith. That is, when a force that causes the pipe of the vertical side member 10 of the upper scaffolding frame member "b" to slip off from the vertical linkage pin 2 is applied to the upper locking projection 3 due to wind pressure, vibration of any other external force, the locking resistance for preventing separation is transmitted to the linkage pin 2 for supporting the upper locking projection 3, and this locking force is received as the lever 14 rests on a wall 17*a* of a lever hole 17 of the vertical linkage pin 2. The lever 14 extends outwardly through the hole 17 beyond the extension of the upper locking projection 3 at the thick middle part 2*a* of the vertical linkage pin 2, and the contact surface with the vertical linkage pin 2 of the actuating lever 14 is wider than that of the upper locking projection 3, so that the external force applied from the vertical side member 10 to the locking projection 3 is received as the lever 14 abuts against the hole wall 17*a* of the lever hole 17, so that a stable locking force can be maintained. Therefore, as shown in FIG. 7, during engagement of the upper locking projection 3 with the lower engaging hole 6 of the vertical side member 10, the locking projection 3 is inserted through an insertion hole 18 in the side of the vertical linkage pin 2 with a gap between the projection 3 and the walls of the hole 18. As the lever 14 is inserted its upper surface 14*a* contacts with the wall 17*a* of the lever hole 17.

Aside from the above features in this embodiment of the invention, the locking force can be also received directly by the wall of the insertion hole 18 of the vertical linkage pin 2 penetrating through the upper locking projection 3.

Figure 8:
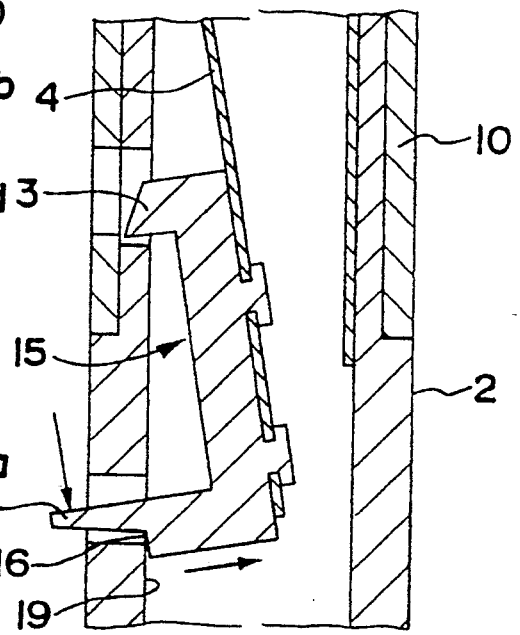

It is another feature of the present invention that the upper scaffolding frame member "b" can be easily separated from the lower scaffold frame "b". More specifically, as shown in FIG. 8, by pressing downwardly on, or kicking against the lever 14 in the invading direction of the arrow against the bias of the leaf spring 4, for example, by the tip of the foot of the worker, the upper locking projection 3 retracts to the inside of the vertical linkage pin 2 together with the lever 14, and the engaging step 16 of the lever 14 of the engaging member 15, engages the inner surface 19 of the vertical linkage pin 2. When the downward pressure against the lever 14 is in the direction of the arrow released, the lever 14 together with the upper locking projection 3, remains largely in the interior of the vertical linkage pin 2 by the continuing engagement of the engaging step 16.

Thus, the vertical side member 10 of the upper scaffolding frame member "b" can be withdrawn from the vertical linkage pin 2 since its lower engaging hole 6 is released from engagement by the upper locking projection 3. After separation of the two scaffolding frame members the worker lightly kicks the lever 14 upwardly with the tip of the foot, whereupon the engaging step 16 of the lever 14 becomes disengaged from the inner surface 19 of the vertical linkage pin 2, and the lever 14 and the upper locking projection 3 of the engaging member 15 return to their initial projecting state achieved through the thrusting of the leaf spring 4, making the locking mechanism ready for reuse. Thus, the lower and upper scaffolding frames "a" and "b" can be easily disassembled by a single worker.

Figure 9:
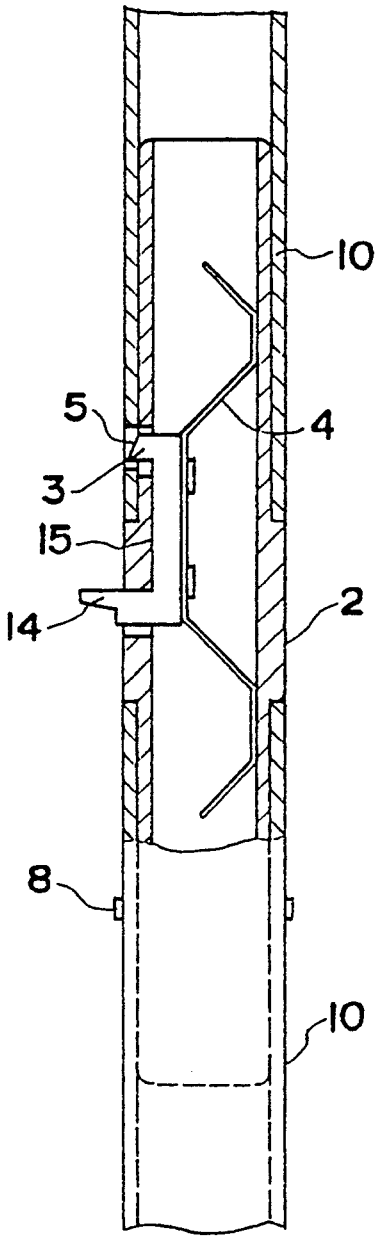
FIG. 9 is a partial cross-sectional front view of another embodiment of the invention.
Figure 5:
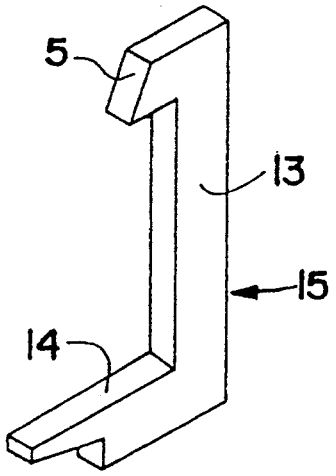
FIG. 5 is a perspective view of the engaging member.

FIG. 9 shows another embodiment of the present invention, in which an approximately W-shaped leaf spring 4 is attached to the backside of the engaging member 15 in a similar manner as shown in the embodiment of FIG. 14. The embodiment of FIG. 9 supports the lever 14 and the upper locking projection 3 of the engaging member 15 in a more stable manner.

The form of the spring 4 is not limited to these two embodiments, but, for example, a spiral shaped spring can be attached to the backside of the engaging member 15.

In maintaining the engaging member 15 inside the vertical linkage pin 2, first the spring 4 is attached to a the back side of the engaging member 15 to form a unit. This unit is then inserted into the interior at the vertical linkage pin 2 through an opening in its end, and the upper locking projection 3 and the lever 14 are permitted to be thrust by the spring 4 through the insertion hole 18 and lever hole 17 respectively, making assembly extremely easy.

According to the present invention, upon inserting the vertical linkage pin 2 into the lower end of the upper scaffolding frame member "b", the lower end of the upper scaffolding frame member abuts against the sloping sliding surface 5 of the upper locking projection 3 as insertion takes place. The locking projection 3 is pushed into the interior of the vertical linkage pin 2 against the bias of the spring 4 and this permits the lower end of the upper scaffolding frame member "b" to be inserted into the vertical linkage pin 2 attached to the lower member "a", until the locking projection 3 of the lower scaffolding frame member faces the lower engaging hole 6, the locking projection 3 is released from the inward pressure of the upper scaffolding frame member and the locking projection 3 is thrust outwardly by the spring 4 to become engaged within the lower engaging hole 6, so that the lower and upper scaffolding frame members "a", and "b" become automatically linked with each other. That is, simply inserting the lower end of the upper scaffolding frame into the vertical linkage pin 2 in the lower scaffolding frame automatically establishes and completes the linkage and assembly of the frame members. Assembly can be facilitated further by lightly pressing the lever 14 during insertion.

When attaching the vertical linkage pin 2 to the upper end of the lower scaffolding frame member "a" simply by inserting the vertical linkage pin 2 into the upper end of the lower member, the locking projection 8*a* of the linking member 8 is engaged with the upper engaging hole 9 in the lower scaffolding frame, so that the lower frame and the linking member are automatically linked and fixed together.

Since the upper locking projection 3 and the actuating lever 14 are all parts of the engaging member 15 across the rod 13, the upper scaffolding frame member is positively received and is securely held together with the lower frame.

The engaging member 15 can also be maintained in the interior of the vertical linkage pin 2, by engaging the step 16 against the hole 17. In this manner the upper and lower scaffolding from members can be easily joined to each other and easily taken apart, without being locked together.

Since in accordance with the present invention an external force applied against the upper locking projection 3 is also taken up by the lever 14 and the wall 17*a* of the lever hole 17, external load is dispersed over the entire engaging member 15 between the locking projection 3 and the actuating lever 14. This enables maximum avoidance of harmful local loads and stresses.

I claim:

1. A scaffolding frame system which comprises a scaffolding frame member adapted to be linked at its top and its bottom to respective upper and lower other like scaffolding frame members, said member having (i) a pair of elongated vertical members that have respective tubular upper and lower ends with hollow interiors, (ii) a cross member integrally joined between and with said pair of vertical members, (iii) a pair of linking members each disposed in a respective upper end of each of said elongated vertical members, said linking members having means for releasable attachment to the lower end of the upper other like scaffolding frame member, said means for releasable attachment of each of said linking members being provided with an upper attaching member that is retractable into the linking member, the upper attaching member having a spring biased movable locking portion for selective engagement with a hole in the lower end of the upper other like scaffolding frame member, said linking member having two holes in it one above the other for selective disposition therein of portions of said spring biased movable locking portion, the last said portion comprising a locking projection and a releasing projection wherein said locking projection is provided for locking the lower end of the upper other like scaffolding frame member to said linking member when said locking projection projects through the upper hole, and said releasing projection projects through the lower hole for selectively unlocking said locking projection upon receiving an unlocking actuation for separation of the locking of the lower end of the upper other like scaffolding frame member from said linking member, said releasing projection having a lower end provided with an engaging step for engaging the interior of said linking member upon receiving the unlocking actuation for retaining said locking projection from projecting through said holes.

2. The scaffolding frame system of claim 1, further comprising a pair of attaching means for the releasable attaching of each said linking members to an upper end of a respective vertical member, each of said linking members having a lower attaching member that is retractable into the linking member, said lower attaching member being a spring biased movable lower locking pin, and each upper end of said vertical members having a hole therein for selective locking engagement with said movable lower locking pin.

3. The scaffolding frame system of claim 1, wherein said locking projection has a front sloping surface for sliding upon the hollow interior of the lower end of the upper other like scaffolding frame member until said locking projection is in locking engagement with the hole.

* * * * *